US010253469B2

(12) United States Patent
Brackin et al.

(10) Patent No.: US 10,253,469 B2
(45) Date of Patent: Apr. 9, 2019

(54) SINGLE ANCHOR TERMINAL

(71) Applicant: THE TEXAS A&M UNIVERSITY SYSTEM, College System, TX (US)

(72) Inventors: Michael S. Brackin, Bryan, TX (US); Dean C. Alberson, Bryan, TX (US); Roger P. Bligh, College Station, TX (US); Delbert Lance Bullard, Jr., College Station, TX (US)

(73) Assignee: THE TEXAS A&M UNIVERSITY SYSTEM, College Station, TX (US)

( * ) Notice: Subject to any disclaimer, the term of this patent is extended or adjusted under 35 U.S.C. 154(b) by 404 days.

(21) Appl. No.: 14/926,935

(22) Filed: Oct. 29, 2015

(65) Prior Publication Data

US 2016/0130775 A1 May 12, 2016

Related U.S. Application Data

(60) Provisional application No. 62/102,903, filed on Jan. 13, 2015, provisional application No. 62/076,231, filed on Nov. 6, 2014.

(51) Int. Cl.
*E01F 15/06* (2006.01)

(52) U.S. Cl.
CPC ..... *E01F 15/06* (2013.01)

(58) Field of Classification Search
CPC ..... E01F 15/06; E01F 15/0461; E04H 17/08; E04H 17/22
USPC ..... 256/13.1
See application file for complete search history.

(56) References Cited

U.S. PATENT DOCUMENTS

| | | | | |
|---|---|---|---|---|
| 3,258,250 | A | 6/1966 | McMullin | |
| 3,982,734 | A | 9/1976 | Walker | |
| 5,039,066 | A | 8/1991 | Stacey | |
| 5,851,005 | A * | 12/1998 | Muller | E01F 15/146 256/13.1 |
| 6,065,738 | A | 5/2000 | Pearce et al. | |
| 6,254,063 | B1 | 7/2001 | Rohde et al. | |
| 6,729,607 | B2 | 5/2004 | Alberson et al. | |
| 6,863,264 | B2 | 3/2005 | Johansson et al. | |
| 6,926,462 | B1 * | 8/2005 | Fuganti | E01F 15/12 256/13.1 |
| 6,932,327 | B2 | 8/2005 | Alberson et al. | |
| 7,037,029 | B2 | 5/2006 | Buehler et al. | |
| 7,364,137 | B2 | 4/2008 | Neusch | |
| 7,367,549 | B2 | 5/2008 | Titmus | |

(Continued)

OTHER PUBLICATIONS

"Washington State Cable Median Barrier," Albin, Richard B., Bullard, Jr., D Lance, and Menges, Wanda L., Transportation Research Record 1743 Paper No. 01-0276, dated 2001, p. 71.

(Continued)

*Primary Examiner* — Jonathan P Masinick
(74) *Attorney, Agent, or Firm* — Brinks Gilson & Lione

(57) ABSTRACT

A single anchor terminal is provided for a roadside wire rope barrier. The single anchor terminal includes a release post, a brace, and an anchor base. The brace supports the release post in an upright position and extends from the release post to the anchor base. The brace has a first portion attached to the release post and a second portion coupled to the first portion with a release component. The anchor base includes a main post that supports the release post and a brace anchor that is coupled to the main post.

17 Claims, 8 Drawing Sheets

(56) References Cited

U.S. PATENT DOCUMENTS

| | | | | |
|---|---|---|---|---|
| 7,398,960 | B2 | 7/2008 | Neusch | |
| 7,401,996 | B2 | 7/2008 | Neusch | |
| 7,556,242 | B2 | 7/2009 | Alberson et al. | |
| 7,568,679 | B2 | 8/2009 | Neusch | |
| 7,694,941 | B2 * | 4/2010 | Abu-Odeh | E01F 15/143 256/13.1 |
| 7,722,282 | B2 * | 5/2010 | Meidan | E01F 15/088 404/6 |
| 7,798,741 | B2 | 9/2010 | Neusch | |
| 7,883,075 | B2 | 2/2011 | Abu-Odeh | |
| 8,266,803 | B2 | 9/2012 | Neusch | |
| 8,286,950 | B2 | 10/2012 | Neusch | |
| 8,448,913 | B1 * | 5/2013 | Rohde | E01F 15/143 248/548 |
| 8,757,597 | B2 | 6/2014 | James | |
| 2003/0213946 | A1 | 11/2003 | Alberson et al. | |
| 2006/0017048 | A1 | 1/2006 | Alberson et al. | |
| 2009/0003932 | A1 * | 1/2009 | Neusch | E01F 13/12 404/6 |
| 2009/0121205 | A1 | 5/2009 | Dallas | |
| 2011/0062402 | A1 | 3/2011 | Neusch | |
| 2011/0062403 | A1 | 3/2011 | Neusch | |
| 2012/0199802 | A1 | 8/2012 | James | |
| 2013/0008007 | A1 | 1/2013 | Neusch | |
| 2013/0015420 | A1 | 1/2013 | Neusch | |

OTHER PUBLICATIONS

International Search Report in International Application No. PCT/US15/56879 filed Oct. 22, 2015, dated Mar. 4, 2016, 4 pages.
Written Opinion in the ISR, in International Application No. PCT/US15/56879 filed Oct. 22, 2015, dated Mar. 4, 2016, 15 pages.

* cited by examiner

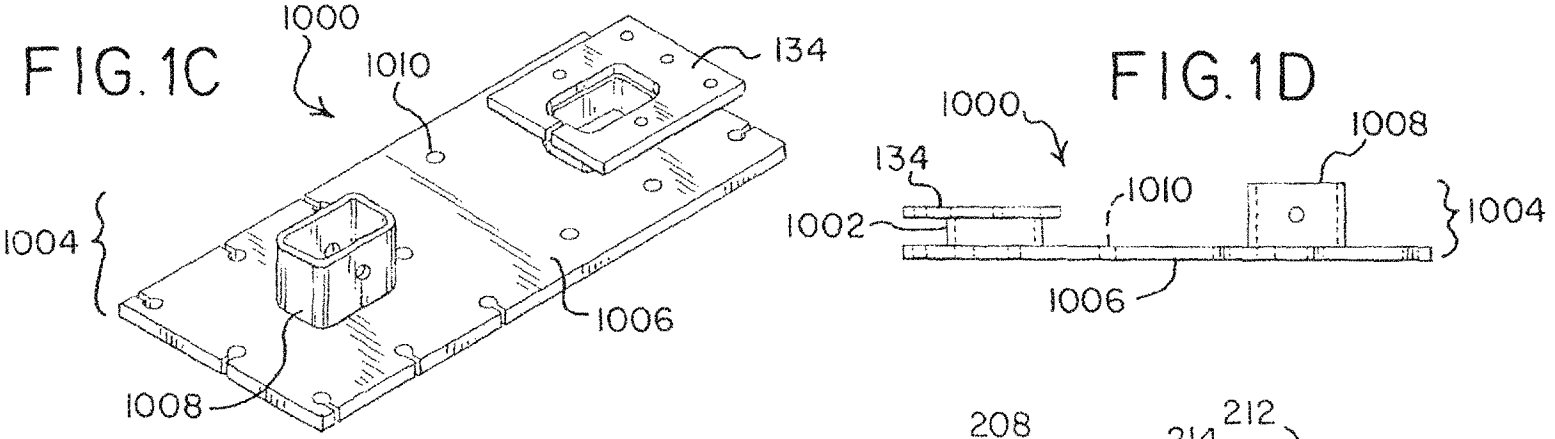
FIG. 1C
FIG. 1D
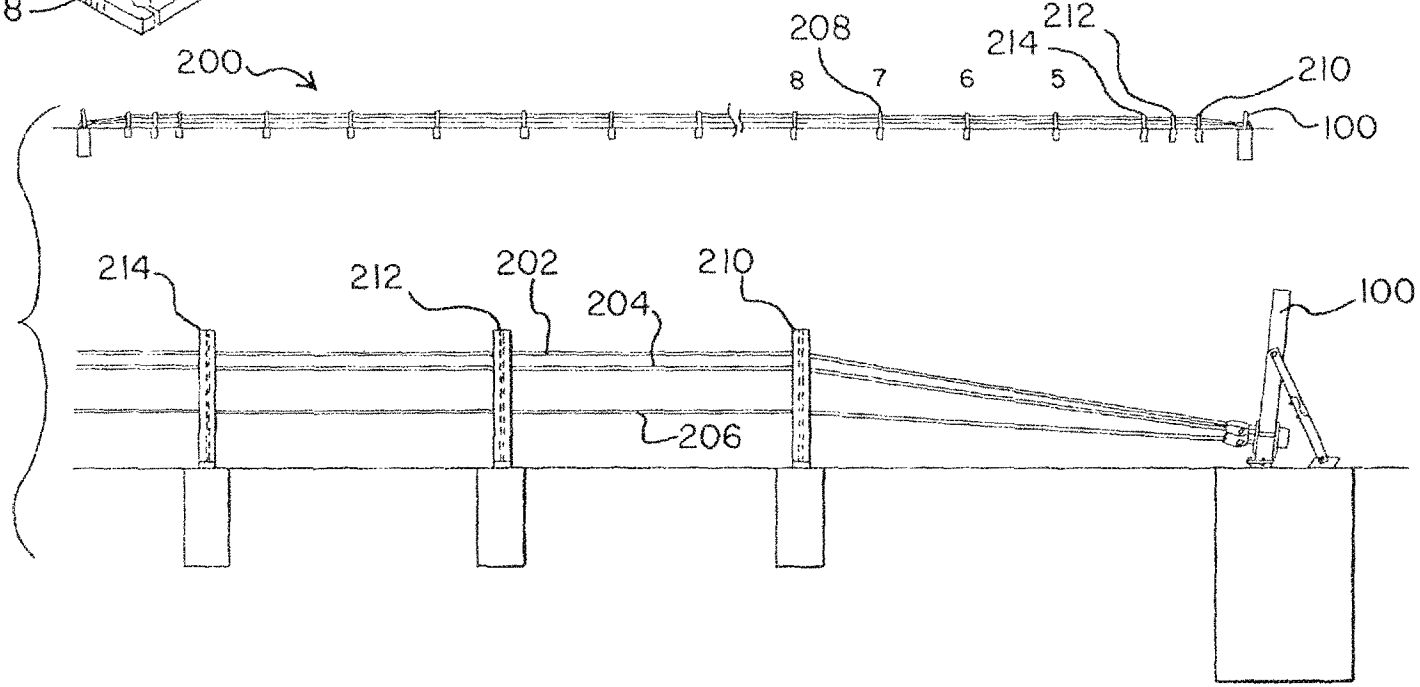
FIG. 2

SINGLE ANCHOR TERMINAL

This application claims the benefit of U.S. Provisional Application No. 62/102,903, filed Jan. 13, 2015, and also claims the benefit of U.S. Provisional No. 62/076,231, filed Nov. 6, 2014, the entire disclosures of which are hereby incorporated herein by reference.

TECHNICAL FIELD

Embodiments disclosed in the present application generally relate to roadside safety systems, and in particular, to terminals and anchors for cable or wire rope roadside safety systems.

BACKGROUND

Traffic barriers and medians are used along roadways to redirect errant vehicles, such as to prevent the vehicles from colliding with oncoming traffic (e.g., head-on collisions with other vehicles) or various other hazards located adjacent the roadway, while minimizing the damage to the vehicle and injury to its occupants resulting from impacting the traffic barrier or median. Roadside safety systems may employ cable or wire rope systems or guardrails. Roadside safety systems may also be designed with a length of need (LON) to prevent collision with specific stationary roadside obstacles or to prevent vehicles from entering areas of concern. Cable or wire rope traffic safety systems are generally installed with foundational structures that extend below grade. Typically, two or more foundational structures may be used to install an anchoring point for the cables. After impact with a vehicle, the many components of the anchoring system may need to be replaced, for example support posts that may have been deformed or otherwise damaged.

Therefore, a need remains for an anchoring system that is cost competitive as well as easy and quick to install, and which has components that may be reused or easily replaced after a collision.

BRIEF SUMMARY

Nothing in this section should be considered to be a limitation on the claims of this application.

In one aspect, one embodiment of a single anchor terminal includes a release post, a cable, a brace and an anchor base. The cable has an end portion that is releasably coupled to the release post and extends from the release post in a first direction. The brace supports the release post in an upright position and extends from the release post in a second direction that is opposite the first direction. The brace includes a first portion that is attached to the release post and a second portion that is coupled to the first portion with a release component. The anchor base includes a main post that supports the release post and a brace anchor that is coupled to the main post. The second portion of the brace is coupled to the brace anchor.

In another aspect, one embodiment of a cable release system for a single anchor terminal includes a pair of keeper plates disposed on opposing first and second sides of a release post of the single anchor terminal, a pair of notched plates disposed adjacent the keeper plates, and a brace that extends from the release post to support the release post in an upright position. The keeper plates each have apertures adapted to receive an end portion of a cable that extends in a first direction from the release post. The notched plates each have lateral notches adapted to receive the end portion of the cable, and the lateral notches align with the apertures of the keeper plates. The brace extends in a second direction opposite the first direction.

In another aspect, one embodiment of a tension release system for a single anchor terminal includes a brace that extends from a release post of the single anchor terminal to a brace anchor that has an above grade portion and a below grade portion. The brace has a first portion and a second portion that have adjoining portions. The adjoining portions of the first and second brace portions each have a catch and an indent. The catch has an inclined surface and a flat surface opposite the inclined surface and the indent has an inclined surface and a flat surface opposite the inclined surface of the indent. A distal end of the first portion is attached to the release post and a distal end of the second portion is attached to the above grade portion of the brace anchor. The distal ends of the first and second portions form opposing ends of the brace.

In yet another aspect, one embodiment of a method for installing a single anchor terminal includes attaching a brace anchor to a main post of the single anchor terminal, such that the brace anchor forms a truss that extends from the main post. At least a portion of the brace anchor and the main post are installed below grade, and a release post is supported by the main post. The release post is supported in the upright position by inserting a brace between the release post and the brace anchor. Inserting the brace includes coupling a first portion of the brace to the release post and coupling a second portion of the brace to an above grade portion of the brace anchor. The method also includes adjoining the first and second portions with a release component.

In another aspect, an embodiment of a method for triggering a release of a cable from a single anchor terminal includes impacting a first side of a brace of the single anchor terminal. The brace has a first portion that extends from a release post and a second portion that is coupled to the first portion with a release component. The brace supports the release post in an upright position by providing resistance against tension that is applied by the cables on the release post in a first direction. The release post is supported by an anchor base. The method also includes triggering the release component, which decouples the second portion from the first portion of the brace and releases the release post from the brace anchor.

In yet another aspect, an embodiment of a method for triggering release of cables from a single anchor terminal includes impacting a cable with a vehicle in a lateral direction. The cable has an end portion that is releasably coupled to a release post of the single anchor terminal and the cable extends in a first direction through apertures of a pair of keeper plates that are disposed on opposite first and second faces of the release post. The cable further extends into laterally opening notches of a pair of notched plates that are disposed adjacent the keeper plates. A tensile load is applied to the cable, thereby applying a tensile load to the brace that support the release post in an upright position. The brace extends from the release post in a second direction opposite the first direction and includes a first portion attached to the release post and a second portion coupled with the first portion by a release component. The cable breaking the keeper plates, which releases the cable from the laterally opening notches.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

BRIEF DESCRIPTION OF DRAWINGS

FIG. 1C is an isometric view of an anchor base for a single anchor terminal;

FIG. 1D is side view of an anchor base for a single anchor terminal;

FIG. 2 is a side view of a cable or wire rope roadside safety system that includes line posts, terminal posts, and single anchor terminals, with an enlarged partial view of the cable or wire rope roadside safety system.

DETAILED DESCRIPTION

Figure 1B:
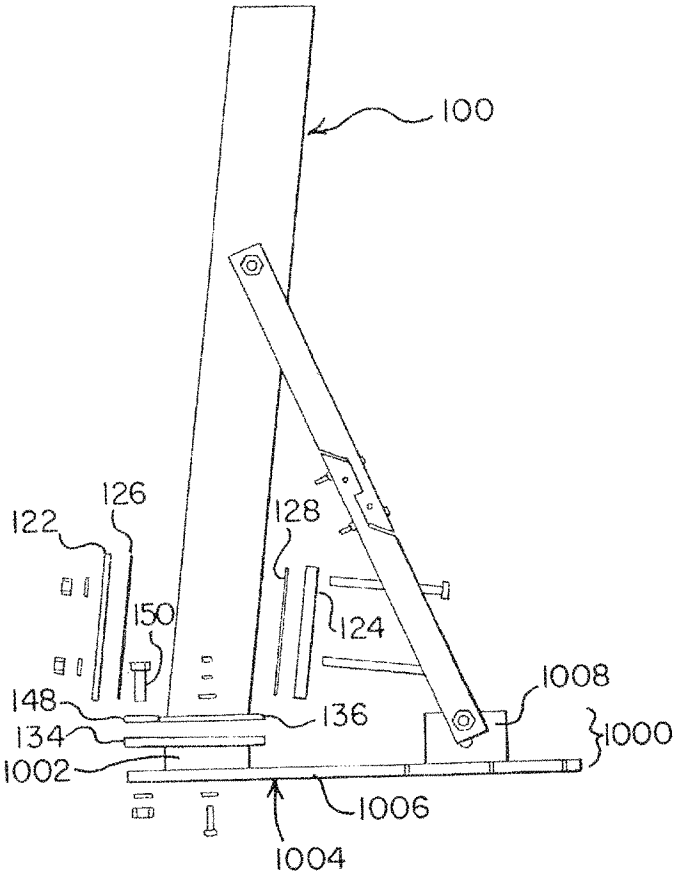
FIG. 1B is a side view of a single anchor terminal having a release post, a brace, and an anchor base.

Various embodiments and/or implementations are described below with reference to the drawings. The relationship and functioning of the various elements of the embodiments may better be understood by reference to the following detailed description. However, embodiments are not limited to those illustrated in the drawings. It should be understood that the drawings are not necessarily to scale, and in certain instances details may have been omitted that are not necessary for an understanding of embodiments disclosed herein, such as—for example—conventional fabrication and assembly. As used herein, the terms "embodiment" and "implementation" refer to examples of elements and/or configurations disclosed herein. The invention is defined by the claims, may be embodied in many different forms, and should not be construed as limited to the embodiments set forth herein; rather, these embodiments are provided so that this disclosure will be thorough and complete, and will fully convey enabling disclosure to those skilled in the art.

As used in this specification and the claims, the singular forms "a," "an," and "the" include plural referents unless the context clearly dictates otherwise. Directional terms "front," "rear," "up," "down," and variations thereof, refer to a relative direction, position, or orientation of an element, and do not limit the element to a particular configuration, unless otherwise specified. For example, a front side, edge or face, may refer to a rear side, edge or face, when an element is flipped from side to side, or upwards may refer to downwards when an element is turned 180 degrees. Ordinal numbers, such as "first," "second," "third," are used herein to distinguish one element or component from another, but do not limit the order, orientation, or configuration of such elements in any way, unless specifically stated otherwise. For example, a first direction may refer to a forward or rearward direction, and a second direction may refer to a direction other than the first direction, or the first direction may be termed a second direction and vice versa, without departing from the scope of the present disclosure. The terms "cable," "wire rope," and "rope" are used interchangeably herein to refer to a length of steel or other metallic strands, or other resilient material, twisted, braided, or otherwise bound together, to create a cable having a sufficient overall diameter and length suitable for use in a roadside safety system to redirect errant vehicles upon impact of the vehicle with the cable or wire rope.

Some embodiments and implementations of a single anchor terminal for a roadside wire rope barrier and methods for installing and assembling a single anchor terminal are provided. Also provided are some embodiments and implementations of a method for triggering release of a cable from a single anchor terminal. The single anchor terminal includes a release post, a knee brace that supports the release post in an upright position, and an anchor base that includes a main post and a knee brace anchor. The knee brace extends rearwardly from the release post and includes an upper portion and a lower portion. The upper and lower portions of the knee brace are coupled with a release component. The main post of the anchor base supports the release post and the knee brace anchor is coupled to the knee brace. A cable is releasably coupled to the release post by an end portion of the cable, and the cable extends forwardly, or in the opposite direction to which the knee brace extends, from the release post. The other end of the cable is attached to another terminal, such as another single anchor terminal or other terminal, such that the length of the cable between the terminals is in high tension.

Figure 1A:
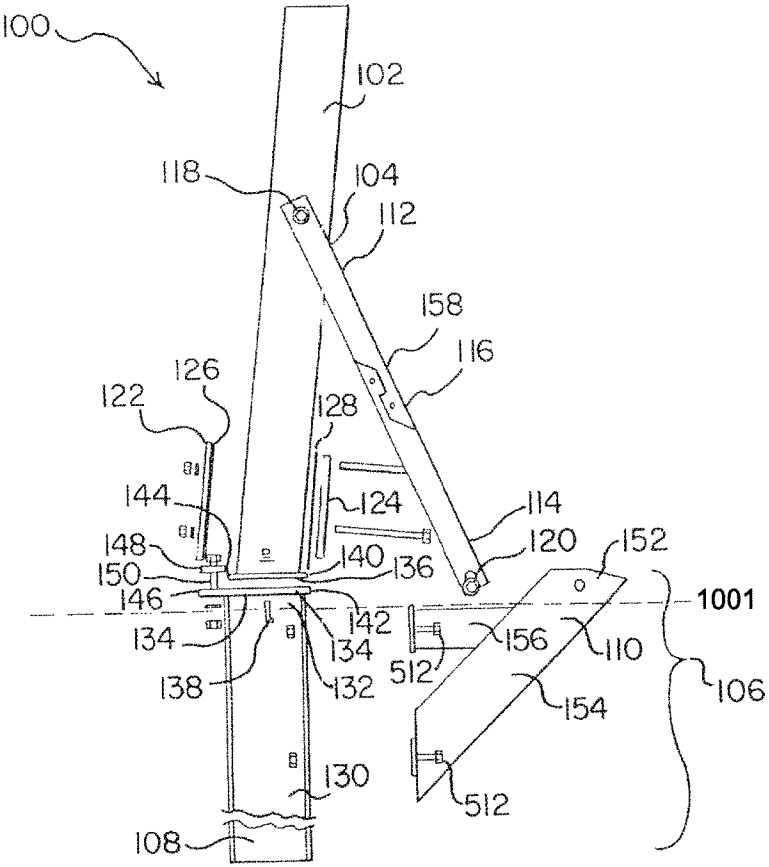
FIG. 1A is a side view of a single anchor terminal having a release post, a brace, and an anchor base.

An implementation of a single anchor terminal 100 is shown in FIG. 1A. The single anchor terminal 100 includes a release post 102 and a brace 104 that extends from the release post 102 and supports the release post 102 in an upright position. The single anchor terminal 100 also includes an anchor base 106 having a main post 108 and a brace anchor 110 that extends from the main post 108 in the same direction as the brace 104. The brace 104 includes a first portion 112 and a second portion 114 adjoined or connected to the first portion 112 with a release component 116. The first and second brace portions 112, 114 can also be held together using fasteners 158 (e.g., machine screw with nut and bolt) that are designed to fail in tension. The release component allows the first and second brace portions 112, 114 to separate and/or become incapable of carrying a tension load. The release component may be configured, for example, as a fuse, fasteners 158, tabs, or other connectors, or a weakened portion, whether by thinning, providing holes or other mechanical or chemical weakening, or any combination thereof.

The first portion 112 is attached to the release post 102, for example with a fastener or hinge 118, and may be rotatable relative to the release post 102. The second portion 114 of the brace 104 is attached to the brace anchor 110, such as by a fastener or hinge 120, and may be rotatable relative to the brace anchor 110. In some implementations, the release post 102 is angled relative to the ground, or inclined or angled towards the brace 104, and the brace 104 is inclined or angled towards the release post 102. In some implementations, a pair of notched plates 122, 124 is disposed on opposite first and second faces of the release post 102 and a pair of keeper plates 126, 128 is disposed adjacent the notched plates 122, 124. Some implementations of the single anchor terminal 100 include only one notched plate or three or more notched plates and/or one keeper plate or three or more keeper plates. The notched plates 122, 124 and keeper plates 126, 128 may each be formed as a single component or may comprise multiple components joined together. The release post 102 may include one or more holes strategically placed to cause the release post 102 to yield in a predictable, safe manner.

Figure 9:
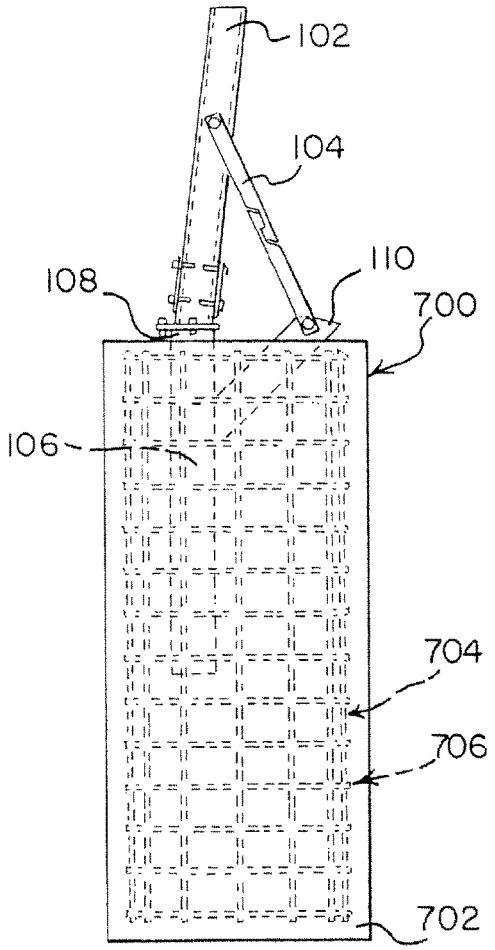
FIG. 9 is a side view of a single anchor terminal installed in a reinforced foundation.

In some implementations, as shown in FIGS. 1B-1D, an embodiment of anchor base 1000 is provided for a single anchor terminal 100. The anchor base 1000 includes a main post 1002 and a brace anchor 1004 that extends from the main post 1002 in the same direction as the brace 104. The brace anchor 1004 includes a base plate 1006 and a brace base 1008. In such implementations, the entire anchor base 1000 may be mounted above grade 1001, such as by threaded rods inserted through openings or apertures 1010 formed in the base plate 1006 and into a foundational structure, such as a foundational pillar as shown in FIG. 9 and as discussed in further detail below. The anchor base 1000 may be installed so that each edge of the base plate 1006 is at least 12 inches from the edge of the foundation. Mounting the anchor base 1000 entirely above grade to an existing foundation, such as a concrete foundational pillar, may provide a convenient, lower cost alternative to embedding a main post 108 that extends further below grade 1001. Benefits of installing the anchor base 1000 entirely above grade 1001 may also include easier replacement of parts and maintenance. Alternatively, the anchor base 1000 may be mounted partially or entirely below grade, for example, by embedding the base plate 1006 in concrete or cement.

As another example, the base plate 1006 may be anchored with fourteen (14) ASTM A449 Ø⅝"×minimum 8" all-thread rods (with washers and hex nuts) and epoxy, with minimum pullout strength of 10,000 lbs and shear strength of 5000 lbs, or Ø⅝" mechanical anchors of comparable strength. The embedment depth of the rods may be 6" or greater with either type, with 2" protrusion (or more or less) above the base plate 1006, and two threads or more exposed above the nut. It is contemplated that other fasteners or mounting systems may be used that would provide similar strength and stability to the system.

Figure 3A:
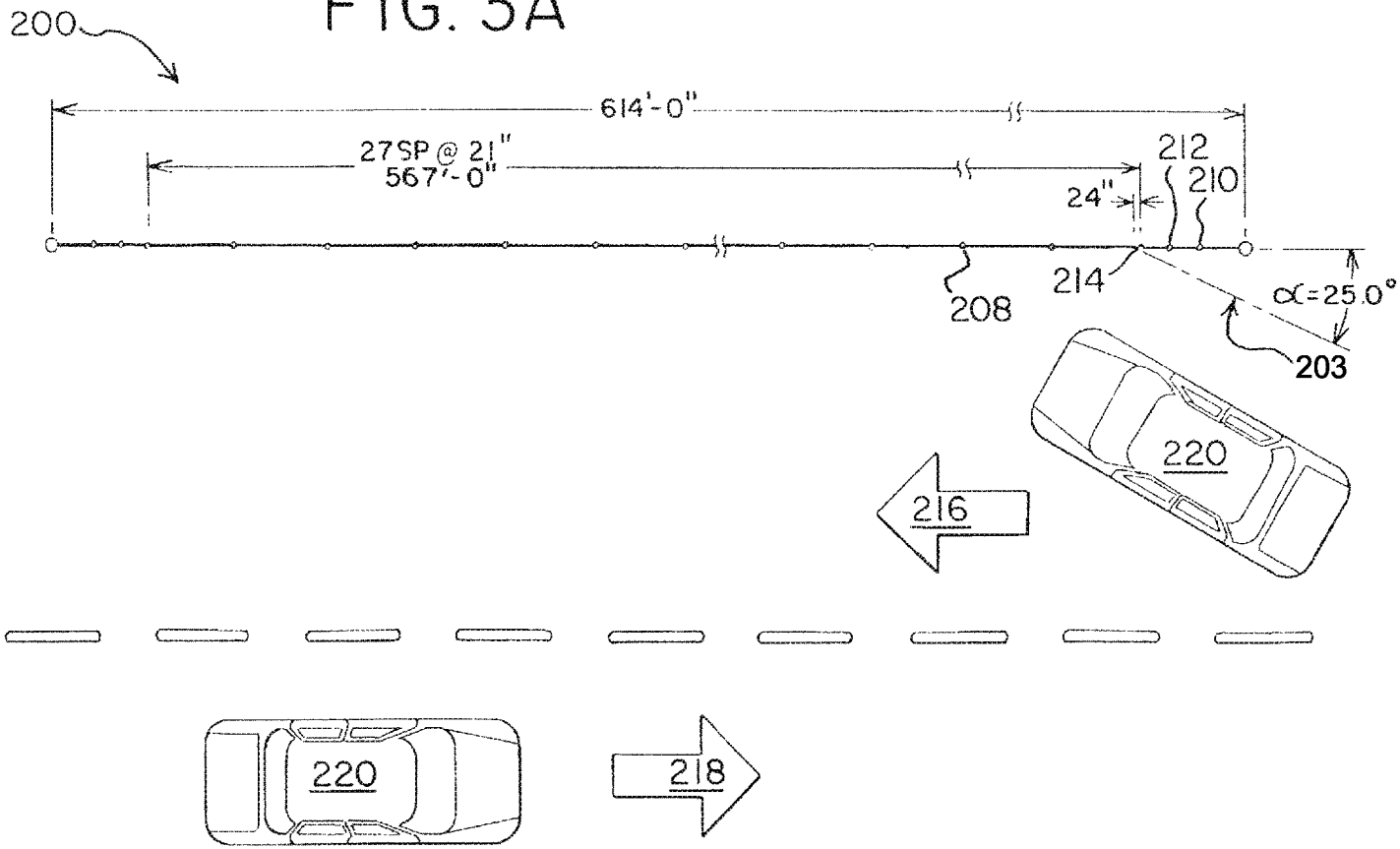
FIG. 3A is a top view of a cable or wire rope roadside safety system along a roadway with a vehicle impacting the cable or wire rope within the length of need.
Figure 3B:
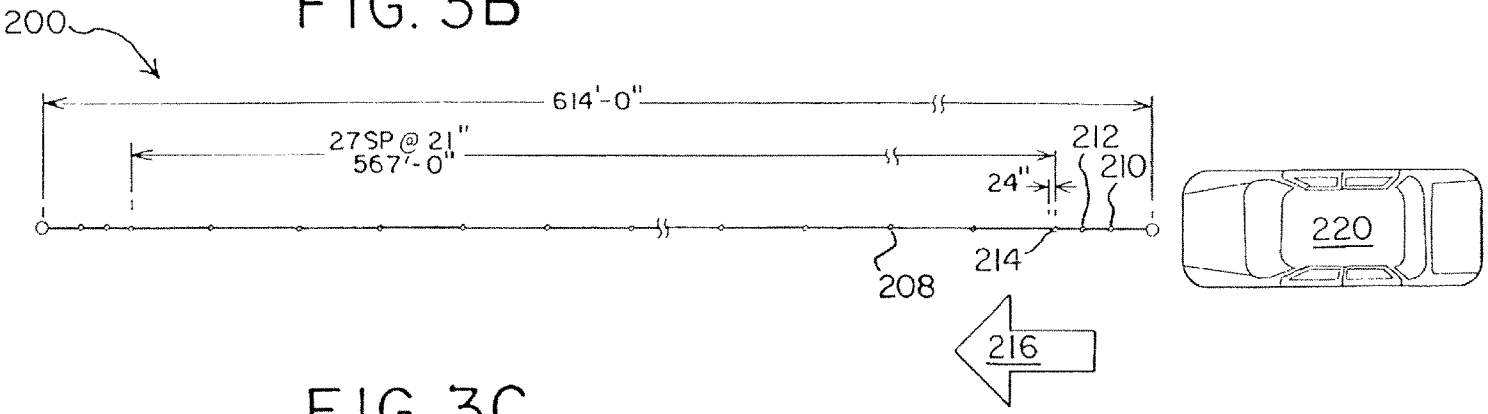
FIG. 3B is a top view of a cable or wire rope roadside safety system along a roadway with a vehicle impacting the brace in a head-on collision.
Figure 3C:
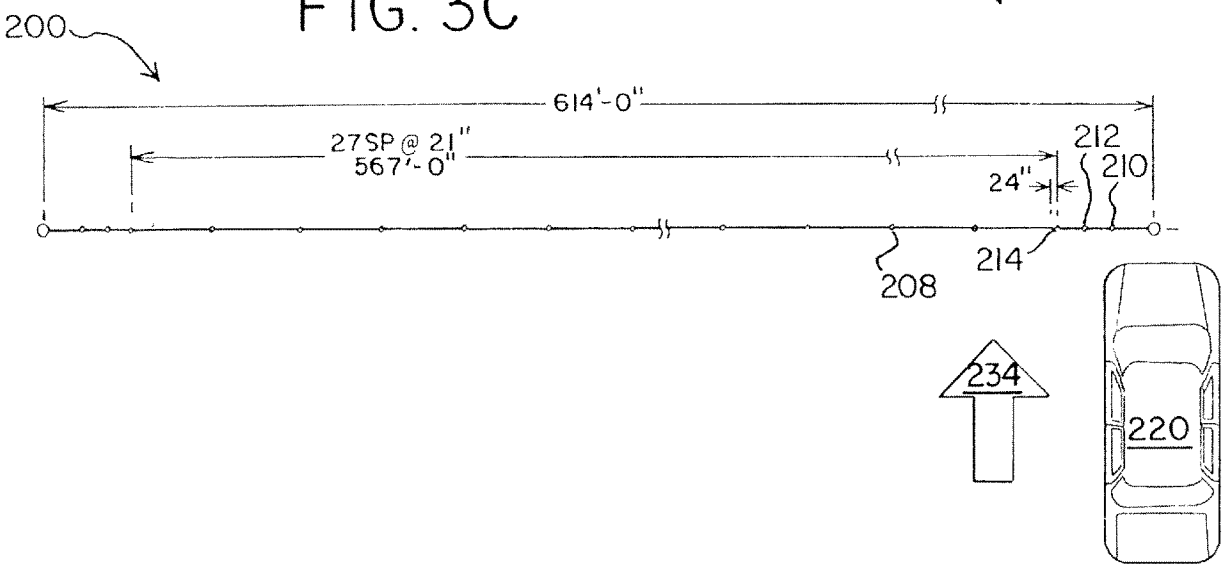
FIG. 3C is a top view of a cable or wire rope roadside safety system along a roadway with a vehicle impacting the cable or wire rope in a lateral collision.
Figure 3D:
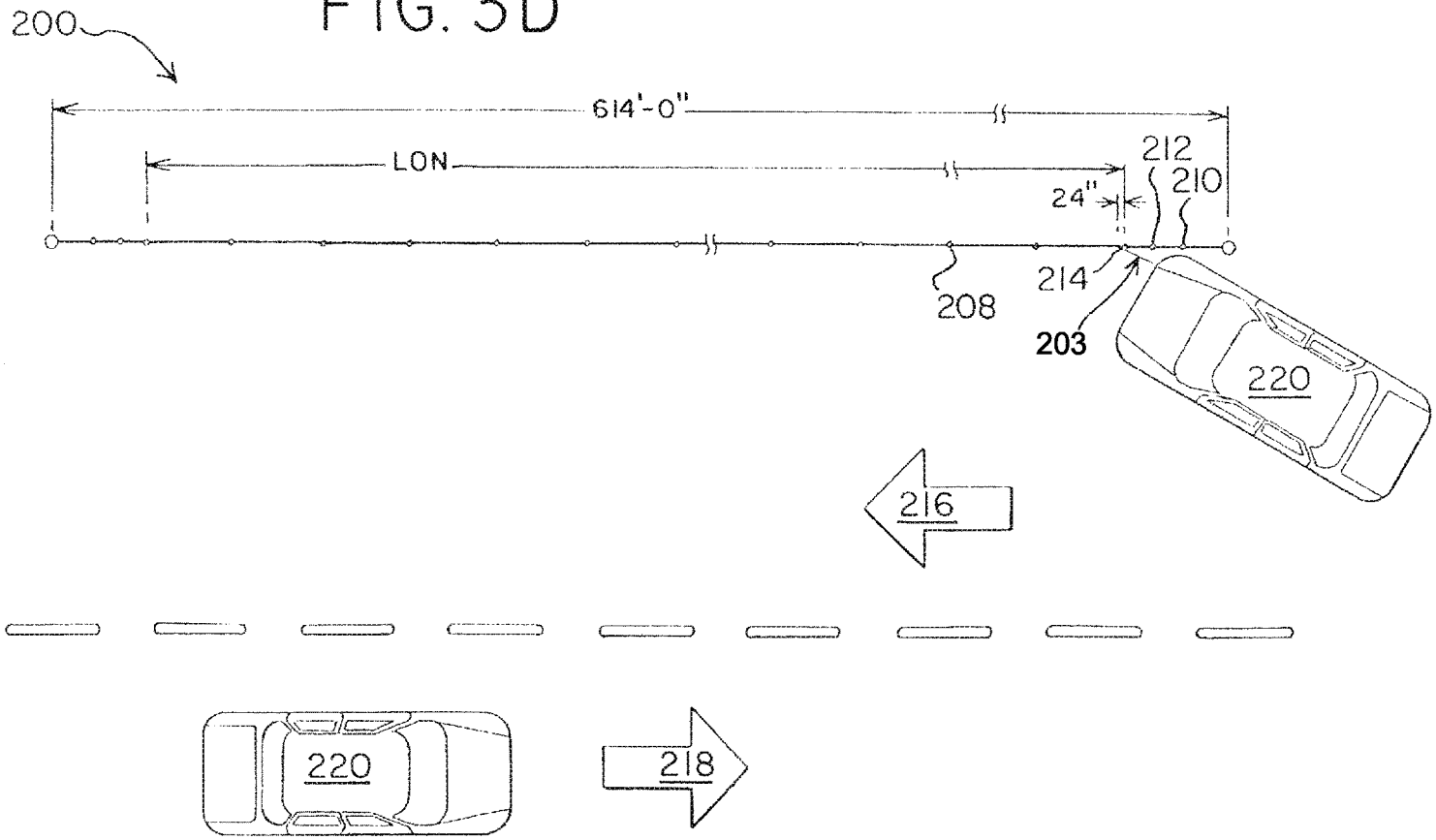
FIG. 3D is a top view of a cable or wire rope roadside safety system along a roadway with a vehicle impacting the cable or wire rope within the terminal section.

As shown in FIGS. 2 and 3A-3D, an exemplary roadside safety system 200 includes cables or wire ropes 202, 204, 206 that are connected to, or extend between, line posts 208, terminal line posts 210, 212, 214, and single anchor terminals 100. Implementations of the roadside safety system may include more or less than three cables or wires ropes. In some implementations, the cables or wire ropes 202, 204, 206 are each a continuous length from end to end of the roadside safety systems or one or more of the cables or wire ropes may be formed from two or more lengths of cable or wire rope connected together to extend from end to end of the roadside safety system. Terminal posts 210, 212, 214 are located nearer the single anchor terminals 100, and are spaced more closely together than the line posts 208. On a two-way road, vehicular traffic travels in a first direction indicated by arrow 216 and a second direction indicated by arrow 218 opposite the first direction. A vehicle 220 traveling in the first direction may impact the roadside safety system 200 along a path of impact 203 at an angle $\alpha$ relative to the longitudinal axes of the cables 202, 204, 206, and within the length of need. In some instances, as shown in FIG. 3B, the vehicle 220 traveling in the first direction may impact the roadside safety system 200 head-on at the brace. In some instances, as shown in FIG. 3C, the vehicle impacts the release post 102 while traveling in a lateral direction 234 that is generally perpendicular to the longitudinal axis of the roadside safety system 200. In some instances, for example, as shown in FIG. 3D, the vehicle impacts the system at a terminal portion of the cables 202, 204, 206 (e.g., between the beginning of the length of need and the single anchor terminal 100 where the cables are supported by terminal line posts 210, 212, 214).

Embodiments of the single anchor terminal 100 are discussed in further detail, including with respect to when the vehicle 220 impacts the cables 202, 204, 206 within the length of need (LON) while traveling in the first direction or the second direction 218 (as shown in FIG. 3A), when the vehicle impacts the brace 104 while traveling in the first direction 216 (as shown in FIG. 3B), when the vehicle impacts the release post 102 and/or brace 104 while traveling in a lateral direction, e.g., generally perpendicular to the first and second directions (as shown in FIG. 3C), and when the vehicle 220 impacts the cables 202, 204, 206 within the terminal section (e.g., the section of the cables supported by terminal posts 210, 212, 214 between the length of need and the single anchor terminal, as shown in FIG. 3D).

In some implementations, for example, as shown in FIGS. 1A-1D and FIGS. 2-4, the cables 202, 204, 206 terminate in end portions 222, 224, 226 that are received in first and second notched plates 122, 124 and extend through first and second keeper plates 126, 128. First notched plate 122 and first keeper plate 126 face away from the release post 102 in the first direction (e.g., in the direction of arrow 216). Second notched plate 124 and second keeper plate 126 face away from the release post 102 in the second direction (e.g., in the direction of arrow 218). The first face of the release post 102 is a surface of the release post facing in the first direction and the second face is a surface of the release post 102 facing the second direction. The release post 102 also has a third face adjacent the first and second faces and a fourth face opposite the third face and adjacent the second and first faces. It should be understood that each face is generally the portion of the component facing in the particular specified direction, and may be, for example, planar, curved, irregular or any combination thereof. The post may have a rectangular cross-section, or other cross-sectional shape or shapes (e.g., circular, H, I, W, U, Z, triangular, etc.). End portions 222, 224, 226 of the cables also include end fittings (or fitting studs) 228, 230, 232 that keep the cable ends from fraying and/or abut against the notched plates 122, 124 and/or keeper plates 126, 128 to maintain tension in the cables 202, 204, 206 between terminals 100.

With reference to FIG. 1A, a portion 130 of the main post 108 may be installed below grade, or below ground surface, such as in a foundation (e.g., a reinforced concrete foundation installed below ground surface S) and a portion 132 of the main post 108 is installed above grade, or above ground surface S. Alternatively, the entire main post 108 is installed below grade. In some implementations, the main post 1002 (e.g., as shown in FIGS. 1B-1D), is preferably installed entirely above grade. It is contemplated, however, that main post 108, 1002 can be installed entirely above grade, partially above grade or entirely below grade. A flat plate 134 is attached, for example, by welding, to the end of the portion 132 of the main post 108, 1002 extending above grade. The flat plate 134 can be rectangular plate of ASTM A36 Steel, or other suitable material, that is 7 inches wide, 8.5 inches high and 0.5 inch thick. A flat plate 136 is also attached, for example, by welding, to one end of the release post 102. The flat plate 136 of the release post 102 is installed on top of the flat plate 134 of the main post 108, 1002 such that corresponding apertures or openings in the flat plates 134, 136 on either of the first or second face of the release post 102 are configured (e.g., sized, shaped, and located) to receive construction bolts 138 that position the release post 102 above the main post 108. In some implementations, the flat plate 136 of the release post 102 is attached directly to the base plate 1006 of anchor base 1000. The shear strap 148 may also be mounted directly to the base plate 1006. In such implementations, the main post 1002 and flat plate 134 are not included. The construction bolts 138 are configured (e.g., sized and of suitable material) to support the release post in an upright position against environmental conditions, such as weather and interactions in regular maintenance. However, when a vehicle impacts the single anchor terminal 100, such as at the cables 202, 204, 206, the release post 102, or the brace 104, the construction bolts 138 are configured to fail without significant deformation. In some implementations, the flat plate 136 of the release post is shorter than the flat plate 134 of the main post 108, 1002, such that a first edge 140 of the flat plate 136 is generally aligned with a first edge 142 of the flat plate 134 of the main post 108, 1002, and a second edge 144 of the flat plate 136 extends towards a second edge 146 of the flat plate 134. A gap between the second edge 144 of plate 136 and the second edge 146 of flat plate 134 is configured to fit a shear strap 148 that is fastened or attached with bolts or fasteners 150, or other means, to the flat plate 134 of the main post 108. The second edge 144 of flat plate 136 abuts against the shear strap 148, so as to prevent the release post 102 from slipping in the first direction due to tension in the cables pulling in the first direction. The bolts or fasteners 150 are configured to hold the shear strap in place during and after vehicle impact in any direction. With reference to FIG. 1A, for example, a portion 152 of the brace anchor 110 may be installed above grade and a portion 154 of the brace anchor 110 may be installed below grade. In some embodiments, the entire brace anchor 110 is installed below or above grade. The brace anchor 110 extends in the second direction away from the main post 108 and is connected to the main post 108 by a strut or connecting arm 156, for example, such that the brace anchor 110 and connecting arm 156 form a triangle, or a truss, with a section of the main post 108. In some implementations, the connecting arm 156 is generally perpendicular to the main post 108 and the brace anchor 110 forms a 45 degree angle with the main post 108. The angle of the connecting arm 156 and the brace anchor 110 may vary in some embodiments without varying from the scope of this disclosure.

Turnbuckles are installed along the cables 202, 204, 206 between line posts to adjust tension along the length of the cables, such as to maintain high tension in the cables. In some implementations, turnbuckles are not installed in or at the terminal 100 or in the transition between the terminal 100 and the length of need (LON). Instead, the turnbuckles are installed between line posts 208, such as between the sixth and seventh posts along the cables, counting the release post 102 of the single terminal anchor 100 as the first post. The cables 202, 204, 206 are arranged in an alternating configuration on opposing faces of the release post 102, such that the top cable 202 and bottom cable 206 are located on the third face of the release post 102 and the middle cable 204 is located on the opposing fourth face of the release post 102. When the single anchor terminal 100 is installed along the side of the road for vehicular traffic traveling in the first direction, as shown in FIGS. 3A-3D, for example, the top and bottom cables 202, 206 are installed on the field side (e.g., nearer the face of the release post facing away from traffic) and the middle cable 204 is installed on the traffic side (e.g., nearer the face of the release post facing traffic). Other implementations may include less than three cables or more than three cables, and the cables may be installed in a different alternating configuration or in any other order, such as with all cables on the field side or the traffic side. In some implementations, the cables comprise strands of steel wire that are twisted, braided, or otherwise bound together, to form a 0.75-inch diameter cable extending a length of 614 feet between the terminal posts 100.

Figure 5:
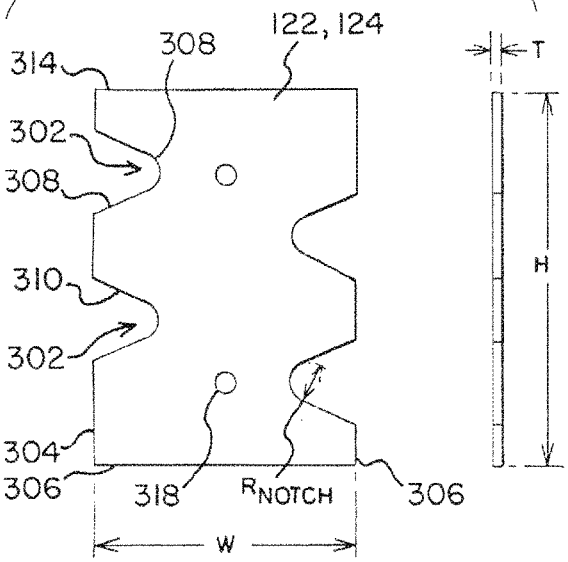
FIG. 5 is a front view of a notched plate for a single anchor terminal.

As shown in FIG. 5, a notched plate 122, 124 has a width W, height H and thickness T with notches 302 formed along, or laterally opening at, the side edges 304, 306 of the plate 122, 124. The notches 302 each have a curved inner edge 308 with a radius $R_{notch}$, a downward sloped edge 310 and an upward sloped edge 312. In some embodiments, the notches 302 have the same radii and the sloped edges are all inclined at the same angle relative to the top or bottom edges 314, 316 of the plate 122, 124. Alternatively, the notches 302 may have varying radii and edges sloped at different angles. The notches 302 are sized to receive the end portions 222, 224, 226 of cables 202, 204, 206. End fittings 228, 230, 232 of the cables are sized to abut against the inner edges 308 of the notches 302 when the cables 202, 204, 206 are in tension. When a vertical, or upward or downward, force is applied to the cables 202, 204, 206, the sloped edges 310, 312 allow the end portions 222, 224, 226 of the cables to slide along the sloped edges 308, 310 and to be released from the notches 302. Although four notches 302 are shown in FIG. 5, other embodiments can include more or less notches. In some implementations, a cable is received in each notch 302. In some implementations, one or more notches 302 remain unused. The notches 302 in opposite edges are arranged in an alternating side-to-side configuration. The notched plate 122, 124 also includes apertures or openings 318 that receive a bolt, or other fastener, to attach the notched plate 122, 124 to the release post 102. Other means of coupling the notched plate 122, 124 to the release post 102 are also contemplated, including for example, welding, rivets, interlocking connections (e.g., interlocking wedges), or any other known mechanical means. In some implementations, the first notched plate 122 is 6 inches wide, 8 inches high and 0.75 inch thick and the second notched plate 124 is 6 inches wide, 9 inches high, and 0.25 inch thick. In other embodiments, the first and second notched plates 122, 124 have different dimensions or share the same dimensions. With reference to FIGS. 2 and 3, when the single anchor terminal 100 is installed along a side of a roadway, some of the laterally opening notches 302 on side edges 304, 306 open towards the traffic and some of the notches 302 open toward the field side (e.g., away from traffic).

Figure 6:
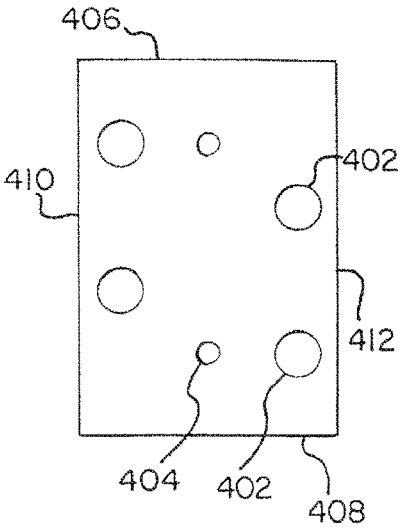
FIG. 6 is a front view of a keeper plate for a single anchor terminal.

FIG. 6 shows an embodiment of a keeper plate 126, 128 in further detail. The keeper plate 126, 128 includes apertures or openings 402 formed therein to receive the end portions 222, 224, 226 of cables 202, 204, 206. The apertures 402 align with notches 302 of the notched plate 122, 124 to allow cables 202, 204, 206 to extend through the apertures 402 of the keeper plate 126, 128 and corresponding notches 302 in the notched plate 122, 124. The keeper plate 126, 128 also has apertures 404 that are configured (e.g., sized, shaped, and located) to receive a bolt, or other fastener, to attach the keeper plate 126, 128 to the release post 102. Other means of coupling the keeper plate 126, 128 to the release post 102 are also contemplated, including for example, any suitable mechanical means, such as using rivets or interlocking components, or welding. Use of fasteners, or other removable or detachable means, may be preferable to allow easier replacement of keeper plates. The top and bottom sides 406, 408 of the keeper plate 126, 128 align with the top and bottom sides 314, 316 of the notched plate 122, 124. The keeper plate 126, 128 also has sides 410, 412 that align with sides 304, 306 of the notched plate 122, 124.

In some embodiments, the keeper plates 126, 128 are disposed between the notched plates 122, 124 and the release post 102. Alternatively, the notched plates 122, 124 are installed between the keeper plates 126, 128 and the release post 102, and the end fittings 228, 230, 232 of the cables abut against the keeper plates 126, 128 to maintain the cables in the notches of the notched plates.

Figure 7:
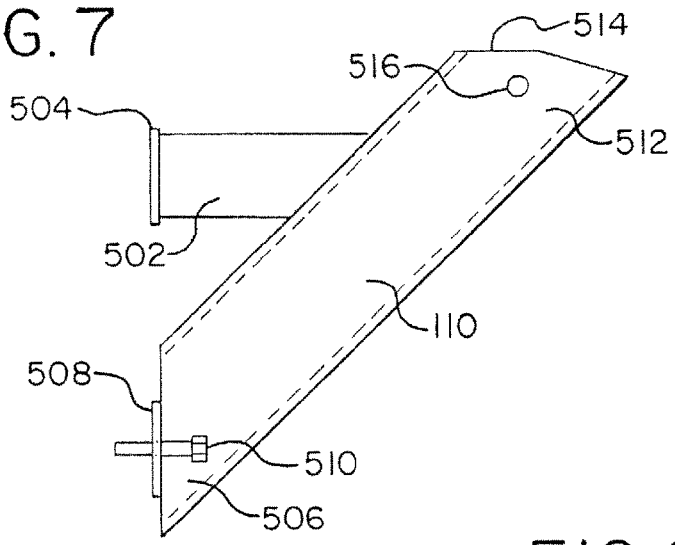
FIG. 7 is a side view of a brace anchor for a single anchor terminal.

As shown in FIG. 7, an example of an embodiment of a brace anchor 110 is formed from a rectangular steel tubing, such as HSS 5"×3"×⅜", ASTM A500 Grade B/C tubing. Use of other structural materials with similar material properties and/or different sized and/or shaped cross sections and/or strength are contemplated. In some embodiments, the brace anchor 110 is formed from wood, plastic, or a composite material with suitable strength and cross-section. The brace anchor 110 is attached to the strut or connecting arm 502, which is attached by an attachment plate 504 to the main post 108. At a first end 506, the brace anchor 110 is connected to the main post 108 by an attachment plate 508 and bolt, or other fastener, 510. The first end 506 of the brace anchor is angled to form a flat or flush connection surface with the main post 108. In some implementations, the brace anchor 110 and connecting arm 502 are attached to the main post 108 by other means, such as directly attached by welding. The second end 512 has a chamfered surface 514 that is generally parallel to the surface S of the ground. The brace 104 of the single anchor terminal 100 is attached to the second end 508 of the brace anchor 110, such as by receiving a bolt or fastener through an aperture or opening 516 in the second end 512 of the brace anchor. When installed, in some implementations, the aperture 516 and chamfer 514 extend above grade to attach with the brace 106. The hollow rectangular tubing forming the brace anchor 110 can be partially or entirely filled with concrete and/or other foundational material for additional reinforcement. The connecting arm 502 can be formed from an I-beam section and is installed below grade, above grade, or partially above grade.

Figure 8:
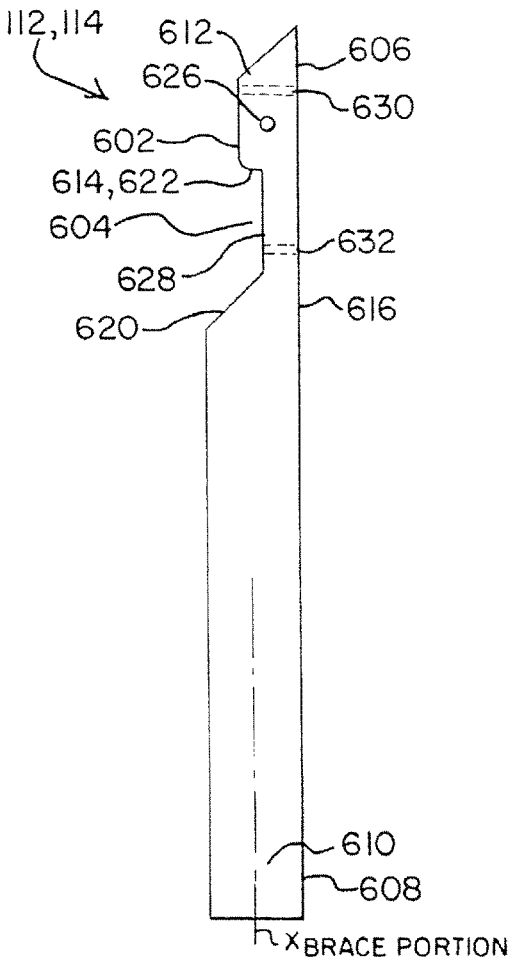
FIG. 8 is a side view of a portion of a brace for a single anchor terminal.

An example of an embodiment of a portion 112, 114 of a brace 104 is shown in FIG. 8. As discussed with respect to FIGS. 1A-1D, the brace 104 includes a first portion 112 and a second portion 114, which can be fabricated as identical portions 112, 114. The brace portion 112, 114 has a catch 602, for example, configured as a tooth, and an indent 604 formed at a first end 606 of the brace portion 112, 114. At a second end 608 of the brace portion 112, 114, an aperture or opening 610 is formed. The catch 602 has an inclined edge 612 and a flat edge 614 that is generally perpendicular relative to a longitudinal axis $X_{brace\ portion}$ of the brace portion 112, 114. In some embodiments, the inclined edge 612 is at a 45-degree angle relative to the surfaces 616, 618 of the brace portion 112, 114. The indent 604 has an inclined edge 620 and a flat edge 622 that is generally perpendicular with the longitudinal axis $X_{brace\ portion}$ of the brace portion 112, 114. The flat edge 622 of the indent 604 forms the flat edge 614 of the catch 602. Alternatively, the catch 602 and the indent 604 are spaced apart and the flat edge 614 of the catch is generally parallel with the flat edge 622 of the indent. The inclined edge 620 of the indent 604 is formed at the same angle as the inclined edge 612 of the catch 602, such that when two portions 112, 114 are arranged at 180 degrees relative to each other the catch 602 of one fits into the indent 604 to form an interlocking connection, wherein the catch 602 of one brace portion fits into the indent 604 of the corresponding brace portion. For example, as shown in FIG. 1A, the first and second portions 112, 114 of the brace 104 are each formed from the exemplary embodiment of portion 112, 114 shown in FIG. 8. The inclined edge 612 of the catch 602 of the first portion 112 faces the inclined edge 622 of the indent 604 of the second portion 114; and the flat perpendicular edge 614 of the catch 602 of the first portion 112 faces the flat perpendicular edge 622 of the indent 604 of the second portion 114.

In some embodiments, the brace portion 112, 114 is machined or formed from ASTM A572 Grade 50 material, with outer dimensions measuring 19.875 inches long, 2 inches wide, and 0.75 thick. To facilitate release of the first and second portions 112, 114 from an interlocking position, as described in further detail that follows, a chamfer 624 is formed in the flat perpendicular edges 614, 622 of the catch 602 and indent 604. The catch 602 also has a flat edge 626 that is generally parallel with the longitudinal axis $X_{brace\ portion}$ and the indent 604 has a flat edge 628 that is generally parallel with the longitudinal axis $X_{brace\ portion}$. A first hole 630 extends from the flat edge 626 of the catch 602 through the surface 616 of the brace portion 112, 114 opposing the flat parallel edge 626 of the catch 602. A second hole 632 extends from the flat edge 628 of the indent 604 through the surface 616 of the brace portion 112, 114 opposing the flat parallel edge 628 of the indent 604. When two brace portions 112, 114 are arranged in an interlocking configuration, the first and second holes or apertures 630, 632 of one brace portion align or are complementary with the second and first holes or apertures 632, 630 in the other brace portion, so as to receive a fastener to hold together the adjoining ends of both brace portions.

An example of a foundation 700 for a single anchor terminal 100 is shown in FIG. 9. The foundation 700 is formed from a concrete column 702 that is reinforced with reinforcing bars 704 and/or reinforcing rings 706. In some embodiments, the anchor base 106 may be installed in a foundational column 700 with a portion of the main post 108 and a portion of the brace anchor 110 extending above grade. In some embodiments, the anchor base 1000 may be installed entirely above grade and on the top surface of the foundational column 700. For example, anchor base 1000 may be mounted to the foundational column 700 using threaded rods, or other suitable fasteners. Alternatively, the base plate 1006 may be mounted above or below grade. The top of the foundational column 700 is flush with the surface of the ground, e.g., at grade. Because the brace anchor 110 is configured to extend from the main post 108, 1002, a single foundational column can provide or support two anchoring points—one for the release post 102 and one for the brace 104. Thus, the single anchor terminal 100 can be easier to install and less expensive than systems that require more than one foundational structure to provide multiple anchoring points.

The system may allow cables to terminate at a location above grade greater that other existing terminal systems. This may provide improved performance during impact because there is less difference in the height at which cables are held at a terminal post 210, 212, or 214 compared to the height at which cables are held at a post 208 within the length of need, and compared to the height at which cables are held at the single anchor terminal 100. Overall terminal length may also be reduced relative to other types of cable barrier systems. Reduction in terminal length may also reduce exposure to impact. The single anchor terminal 100 also may reduce deformation to components and allow more components, such as the release post, to be reused after impact. Single Anchor Terminal Failure Modes.

Failure Mode No. 1: With reference to FIG. 3D, when a vehicle 220 traveling in either the first direction or the second direction impacts the cables 202, 204, 206 within the terminal section (e.g., outside the length of need) of the cables 202, 204, 206, the vehicle 220 can impose lateral forces (e.g., from pushing the cables out away from the road) and vertical forces (e.g., from the cables sliding up over the vehicle or getting caught under the vehicle). Lateral forces applied on cables 202, 206 that are mounted on the field side (or the side opposing the impact side) of the singled anchor terminal will push the cables 202, 206 against outer edges of the apertures 402 on the field side of the keeper plates 126, 128 until the cables 202, 206 tear through the section of the keeper plates 126, 128 between the outer edges of the keeper plate apertures 402 and the outside edges of the keeper plates 126, 128, thereby releasing the field side cables 202, 206 (e.g., allowing the cables to move from an anchored position to a released position, free of any engagement with the keeper plates 126, 128) from the notches 302 that open laterally towards the field side of the notched plates 122, 124. The traffic or impact side cables 204 are pushed against the inner edges of the keeper plate apertures 402 and the inner edges of the notches 302, and rotate about the internal edges of the impact side lateral notches 302 of the first notched plate 122 to generate increasing torque until the keeper plates 126, 128 reach failure mode and allow the impact side cable to tear through the apertures 402 of the keeper plates and release from the impact side lateral notches 302.

Vertical forces applied on the cables 202, 204, 206 may cause the cables to slide along the upward and/or downward sloped edges 308, 310 and out of the notches 302 of the notched plates 122, 124 and break or tear through edge portions of the keeper plates 126, 128, thereby releasing the cables 202, 204, 206 from the anchored position. The first point of failure is in the keeper plates 126, 128, when the cables break or tear through the keeper plate apertures 302. As used herein, the term "break" means to cause a component to reach failure mode at one or more portions or locations on, along, or in the component. The term "breakable" refers to a component that is able to break or fail, such as in a particular failure mode if one is specified, including, for example and without limitation, shearing, tearing, fracturing, and/or other known types of failure.

The keeper plates 126, 128 are designed to maintain sufficient resistance or tension in the cables to redirect the vehicle 220, while minimizing damage to the vehicle and injury to occupants by allowing the cables to tear through the keeper plates 126, 128 after a predetermined load or tension in the cables is reached. The shear strap 148 and brace 104 also provide resistance against movement of the release post 102 in the first direction, so as to maintain sufficient tension in the cables to redirect the errant vehicle 220. The brace portions 112, 114 remain in an interlocked configuration to support the release post 102 in an upright position. In the interlocked configuration, tension in the cables causes the flat perpendicular edge of the catch 602 of the first brace portion 112 to abut against the flat perpendicular edge of the indent 604 of the second brace portion 114. In the released configuration, e.g., when the catch 602 of the first portion 112 is released from the indent 604 of the second portion 114, the brace 104 provides no resistance to the release post 102, and tension in the cables will cause the release post 102 to collapse in the first direction 216 tipping over the edge of the shear strap 148.

Failure Mode No. 2: With reference to FIG. 3A, when a vehicle 220 traveling in either the first direction or the second direction impacts the cables 202, 204, 206 within the length of need, the vehicle 220 can impose lateral forces e.g., from pushing the cables out away from the road). Tension in the cables 202, 204, 206 may redirect the vehicle 220, such as to guide the vehicle 220 back towards the road, or to prevent the vehicle from passing through the cable barrier system into a hazardous zone. In some implementations, the cables 202, 204, 206 may remain in the keeper plates while the vehicle 220 remains in the length of need. In collisions where the vehicle 220 initially impacts the length of need, and continues to travel (in contact with the cables 202, 204, 206) and reach the terminal section, Failure Mode No. 1 may apply if the predetermined load or tension in the cables is reached, as discussed above. It is contemplated, however, that in sufficiently high impact collisions, the cables 202, 204, 206 may release while the vehicle 220 impacts the length of need.

Figure 4:
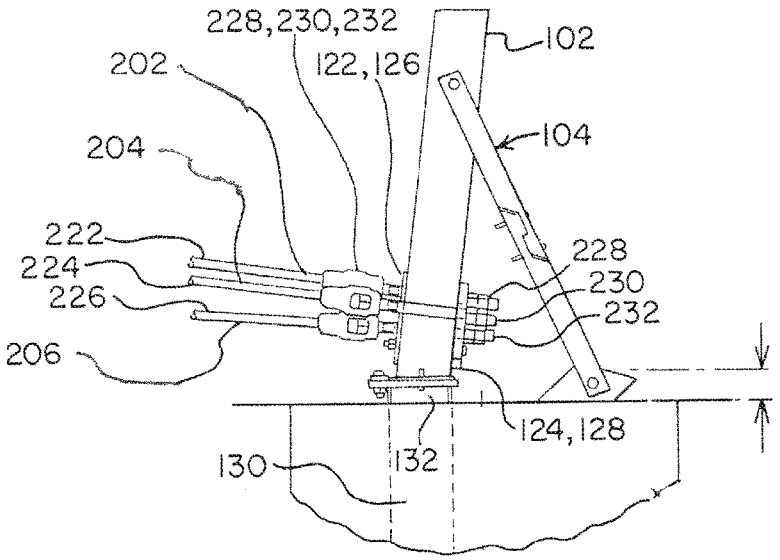
FIG. 4 is a side view of the single anchor terminal with cables installed.

Failure Mode No. 3 (Head-on Impact): When a vehicle 220 is traveling in the first direction 216 and directly impacts the brace 104 (for example, as shown in FIG. 3B), the release component 116 is triggered to release the brace from the interlocked configuration to the released configuration. In other words, the first point of failure is in the brace 104. The release component can include the adjoining portions of the first and second brace portions 112, 114 and the one or more fasteners 158 that hold the teeth 602 and indents 604 of the adjoining ends together, as shown in FIGS. 1 and 4. The release component 116 is triggered when force is applied in the first direction anywhere along the surface of the brace 104 that is facing the second direction. The force in the first direction applies tension in the fastener 158 until the fastener fails in tension and allows the catch 602 of the first portion 112 to be released from the indent 604 of the second portion 114, allowing the brace 104 to fold in and collapse towards the ground. Collapsing the brace portions 112, 114 releases the tension in the release post 102, and tension in the cables can be sufficient to cause the release post 102 to collapse in the first direction, tipping over the shear strap 148. Alternatively, once the release component 116 is triggered, the release post 102 will not resist vehicle impact on the release post 102, and the bolts 158 will fail in tension allowing the release post 102 to collapse without twisting, bending, or otherwise causing significant deformation to the release post 102. Thus, the release post 102 can be reinstalled by replacing the bolts 158 and the brace 104. It is contemplated that in some implementations there will be significant deformation in the release post 102 that would require replacing the release post 102 after the collision.

Failure Mode No. 4 (Reverse Impact): When a vehicle 220 is traveling in the second direction and the first point of impact is with the release post 102, the impact induces compressive forces along the longitudinal axes of the brace portions 112, 114. The inclined edge 612 of the catch 602 of the first brace portion 112 slips against the inclined edge 620 of the indent 604 of the second brace portion 114, and vice versa, thereby triggering the release component 116, decoupling the adjoining ends of the first and second portions 112, 114 of the brace 104, and causing the brace 104 to collapse. In implementations where the adjoining ends of the first and second brace portions 112, 114 are held together by one or more fasteners 158, the brace collapses when the fasteners 158 fail in tension. The fasteners 158 are designed to not to resist impact from vehicles traveling in the second direction, so as to allow the release post 102 to lay over collapse in the second direction after the release component 116 is triggered.

Failure Mode No. 5 (Lateral Impact): When a vehicle 220 impacts the single anchor terminal 100 from a lateral direction (for example, as shown in FIG. 3C), e.g., perpendicular to the first and second directions, the construction bolts 138 and the brace fasteners 158 fail in tension to allow the release post 102 to collapse in the lateral direction (e.g., in the same direction that the vehicle is traveling). The brace 104 does not provide support to the release post 102 in the lateral direction. Collapse of the release post 102 also releases tension from the cables 202, 204, 206. In some collisions, the cables 202, 204, 206 are released from the anchored position.

In one embodiment, the single anchor terminal 100 comprises a high-tension anchor release post 102 coupled to a knee brace 104 and an anchor base 106. The release post 102 may be inclined towards the knee brace 104 to provide for increased wire rope anchorage and release performance. Front and rear notched plates 124, 122 attached to the release post 102 can accommodate lateral and vertical release, but provides a strong tension anchor. Keeper plates 126, 128 retain terminal studs at the end of each wire rope attached to the release post 102. The knee brace 104 includes interlocking members 112, 114 that brace or support the release post 102.

Notched plates 122, 124 and keeper plates 126, 128 may be bolted, welded, or locking to the release post 102. The release post 102 may be a rectangular or W-section, built-up member, solid stock, 3D printed, etc. The notched plates 122, 124 may be formed using the flanges of a W-section release post. The shear strap 148 may be made from various cross-sections or materials, including, for example, cast aluminum, cast iron, cast steel, or other frangible materials. The trigger brace 104 may be made from ductile material that fails by net section fracturing, such as brittle material that fractures on impact, and is strong in tension, weak in bending connection.

Yielding holes may be located on alternate flanges of each terminal post at grade to assist with the post twisting and laying down in a predictable manner. In some implementations, the release post 102 is made of frangible material that fractures in a predictable manner. The system can include terminal posts bolted into sleeved foundations to reduce the possibility of projecting posts. The system is symmetrically designed to be able to work with three or four cables or wire ropes, or any other number of cables or ropes, in both median and shoulder roadway applications. In addition, the system works with various wire rope barrier systems with similar cable heights. The terminal posts are designed to work in either round or square post sleeves.

The single anchor terminal 100 is a roadside safety device that can be used with wire rope safety systems, such as Trinity's Wire Rope Safety System (CASS™) TL-3 or TL-4 wire rope barrier or other National Cooperative Highway Research Program (NCHRP) Report 350 or AASHTO MASH qualified wire rope barriers with similar wire rope heights. The wire rope barrier serves to redirect errant vehicles that leave the roadway, thus aiding in preventing potential head-on collisions with other vehicles. During an impact in the length-of-need (LON), the wire ropes serve to capture and redirect the errant vehicle. The single anchor terminal 100 is designed to provide a single termination point for the cables or wire ropes, in either a three or four wire rope system.

A Trinity CASS™ S3 system and two single anchor terminals 100 were installed, as shown in FIGS. 2 and 3, for a full-scale crash test to evaluate the system's performance in redirecting a passenger pickup truck when impacted at the beginning LON. The system had three wire ropes 202, 204, 206 with an overall length of 614 ft. Each wire rope was 0.75-inch diameter, cut to length, and 1-inch diameter end fittings were field-applied per the manufacturer's instructions. A single 0.75-inch turnbuckle was installed on each wire rope between posts 6 and 7. Turnbuckles were not installed in the terminal or transition between the terminal and LON. Each wire rope 202, 204, 206 was tensioned to the manufacturer's specification of 4200 lb for an installation temperature of 100° F., as specified in MASH.

Single anchor terminals 100 were used for the upstream and downstream anchorage (post 1 and 36). As used herein and with reference to FIG. 3, "upstream" refers to portions of the roadside safety system that precede the point of impact (e.g., to the right of the vehicle 220 shown in FIG. 3), and "downstream" refers to portions that are beyond the point of impact (e.g., to the left of the vehicle 220 shown in FIG. 3). The overall length of each terminal was 23 ft 6 inches and contained three terminal line posts (posts 2 through 4). Post 2 was located 10 ft on center, downstream from the single anchor terminal (post 1). Posts 3 and 4 were each spaced 78 inches on center beyond post 2. The beginning LON for the upstream terminal was defined 2 ft downstream of post 4. The downstream terminal had post spacing and beginning LON equal to the upstream terminal. The beginning LON for the downstream terminal was defined as 2 ft upstream of post 33. Posts in the LON were spaced 21 ft on center between posts 4 and 32.

Figure 10:
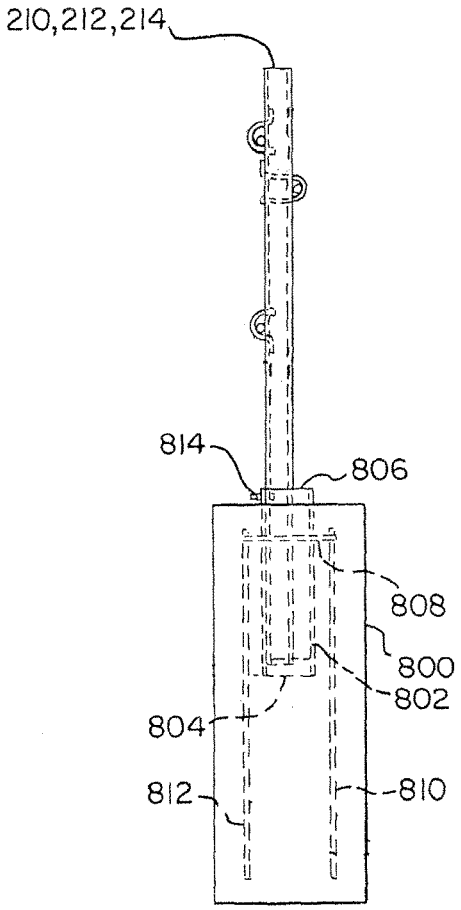
FIG. 10 is a side view of a terminal post installed in foundation as part of a cable or wire rope roadside safety system.

With reference to FIG. 10, the terminal line posts 210, 212, 214 were U-shape Rib Bak #4 posts. Their overall lengths were 48 inches and were inserted into pipe sleeved foundations 800. Their strong axes were oriented perpendicular to the length of the installation and their open face toward the traffic side. The pipe sleeves 802 had outer dimensions of 4 inches×15-inches long and had a 13-gauge wall thickness. The bottom of each pipe sleeve 802 was sealed using a low density polyethylene cap 804 and was installed in 12-inch diameter×32-inch deep drilled shaft concrete foundation 800. The top 806 of each pipe sleeve was 1.25-inches above grade. Each foundation was reinforced using a single 8 inch outer diameter #3 reinforcing ring 808 located approximately 3 inches below the top of the foundation and two vertical #4 reinforcing bars 28-inches long. One vertical bar 810, 812 was placed on the traffic and field side of each pipe sleeve 802. The terminal line posts 210, 212, 214 were inserted to near the full depth of these sleeves. A 0.375-inch diameter hole was located 0.625 inch from the top of each pipe sleeve 802, on the field side. This hole corresponded with a 0.375-inch diameter hole in the web of each terminal line post located approximately 34.375 inches from the top of each post. The terminal line posts were bolted to each sleeve using a single 0.3125-inch diameter bolt 814.

Figure 11:
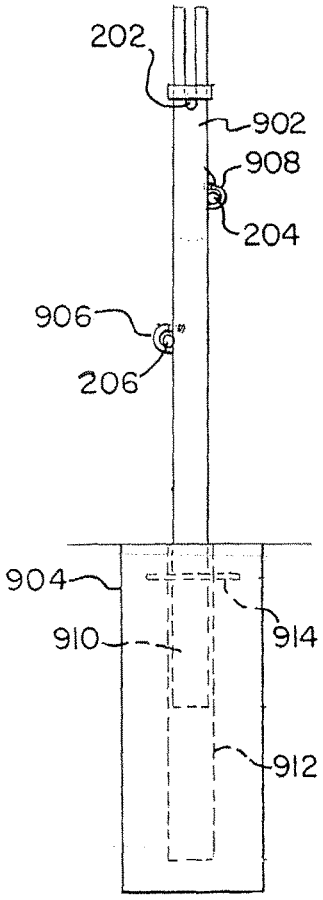
FIG. 11 is a side view of a line post installed in foundation as part of a cable or wire rope roadside safety system.

As shown in FIG. 11, the wire ropes 202, 204, 206 were supported in the LON using slotted posts 902 fabricated from S3×5.7 structural section. Each post 902 was 60-inches long and was inserted 14 inches into a sleeved foundation 904. Their weak axes were oriented perpendicular to the length of the installation. A slot was cut through the web of the S3×5.7 to accept the top wire rope 202. The top wire rope 202 rested in the bottom of the slot and was located approximately 38 inches above grade. A stainless steel shear strap was placed around the S3×5.7 flanges above the top wire rope. The bottom wire rope 206 was positioned approximately 17.75 inches above grade and supported by a 0.3125-inch diameter shoulder hook or "J" bolt 906 attached to the post's flange, opposite of impact and with the open end down. The second wire rope 204 was positioned 29.75 inches above grade and supported by a "J" bolt 908 attached to the other flange with the open end down.

The sleeves 910 had outer dimensions of 3 inches×4 inches×27-inches deep. Each post rested on pre-punched tabs 912 located 14 inches below grade in each sleeve to maintain its vertical height. The sleeves 910 were installed in 12-inch diameter×30-inch deep drilled shaft concrete foundations 904. The top of each sleeve and foundation were flush with grade. Each foundation was reinforced using a single 8-inch outer diameter #3 reinforcing ring 914 placed approximately 3 inches below the top of the foundation.

With reference to FIGS. 1A and 9, the single anchor terminal 100 is a system of components that include a reinforced concrete foundation 702, anchor base 106, and release post 102. The reinforced concrete foundation 702 was a 7-ft deep×36-inch diameter drilled shaft. The foundation 702 was reinforced using 12 vertical #5 reinforcing bars 704 and 14 #3 reinforcing rings 706. The reinforcing rings 706 were 30-inch outer diameter and equally spaced on 6 inch centers. The 12 #5 vertical reinforcing bars 704 were equally spaced inside the reinforcing rings 706 and were 79.5 inches long.

The anchor base 106 was fabricated from W6×15 structural section (e.g., main post 108) capped with a 7 inch×8.5 inch×0.5-inch thick flat plate 134. The W6×15 was set within the reinforced concrete foundation 700, offset 6 inches downstream, center-to-center from the concrete foundation with its strong axis perpendicular to the length of the installation. The flat plate 134 was welded to the top of the W6×15 main post 108 with its 7-inch length oriented parallel to the W6×15 post's strong axis. The edge of the plate 134 was offset 1.75 inches from the downstream flange of the W6×15. The anchor post 108 extended 46.5 inches into the concrete foundation 702. The overall height above grade, to the top of the flat plate 134, was 2 inches. A 7-inch long shear strap 148, fabricated from 2-inch wide×0.375-inch thick flat bar, was bolted to the top, downstream edge of the flat plate 134. These were bolted together using three 0.625-inch diameter bolts 150. These bolts 150 were centered along the centerline of the shear strap 148 and spaced 2.5 inches apart. The anchor base 106 and reinforced concrete foundation 702 were re-used from previous tests performed. The shear strap 148 was re-used from the previous test performed.

The release post 102 was fabricated from an approximately 44.6-inch long HSS3×5×0.375 hollow structural tube section welded to a 7-inch wide×6-inch long×0.25-inch thick flat plate 136. This flat plate 136 nested atop and against the anchor base 106 and shear strap 148, respectively. The release post 102 abuts against the shear strap 148 such that the shear strap 148 prevents the release post from slipping relative to the anchor base while the ropes are in tension. The release post 102 was oriented with its strong axis perpendicular to the length of the installation. The release post 102 tilted upstream 6.5 degrees from vertical. When installed on the anchor base 106, the release post 102 extended approximately 46 inches above grade. The release post 102 was re-used from the previous test performed.

The release post plate 136 and anchor base plate (or flat plate) 134 interlock together for a unidirectional, shear-only connection. This connection was designed to carry shear-only from the tensile load of the wire ropes 202, 204, 206 and cannot develop shear resistance in the reverse direction (i.e., the second direction indicated by arrow 218 as shown in FIG. 3). The shear plane was aligned parallel with grade. To ensure alignment during construction, the two plates were retained together using two 0.3125-inch diameter bolts 138. These bolts 138 were located in the center of the connection, perpendicular to the length of the installation, and 1 inch from each edge of both plates 134, 136. A 1.5-inch diameter hole was drilled in each plate 134, 136 for water drainage and hot-dip galvanizing.

The approximate height of each wire rope 202, 204, 206, horizontally through the upstream terminal (between posts 2 and 4), was 14.25, 25.50, and 29.25 inches above grade from bottom to top, respectively. Between post 2 and the single anchor terminal 100, the wire ropes 202, 204, 206 descend to their respective termination heights. These heights are discussed in detail below. Between posts 4 and 5, the wire ropes 202, 204, 206 ascend to their respective LON heights. Each wire rope 202, 204, 206 was restrained vertically at each post using a single 0.3125-inch diameter locking hook bolt. The locking hook bolts were attached to the terminal line posts through pre-located holes in the web of the posts. The downstream terminal had details and dimensions equal to the upstream terminal.

The wire ropes 202, 204, 206 terminated into the single anchor terminal 100 at approximately 6.8, 8.7, and 10.2 inches above grade at approximate angles of 4.1, 8.9, and 8.9 degrees from horizontal from bottom to top, respectively. These measurements were taken at the intersection of a vertical axis, which is coincident with the midpoint of the base of the release post 108 and each wire rope fitting 228, 230, 232. The wire rope fittings 228, 230, 232 terminate in an alternating (side-to-side), staggered fashion, with the top and bottom wire ropes on the field side and the middle wire rope on the traffic side. An 8-inch×6-inch×0.75-inch thick steel plate 124 and a 9-inch×6-inch×0.25-inch thick plate 122 were attached to the front (downstream) and rear (upstream) of the release post, respectively. The plates 122, 124 had angled notches 302 (as shown in FIG. 5), two each side, that align with a specific wire rope's orientation. The wire rope's fitting stud 228, 230, 232 passes through these notches. The angled faces 310, 312 of the notches facilitate the wire rope's release if a significant vertical load is induced. This connection provides strength in tension, but releases if significant lateral or vertical loads are induced. The wire rope fittings 228, 230, 232 are held in place using two 20-gauge steel keeper plates 126, 128, on each side of the release post 102. These plates 126, 128 were located between the front and rear notched plates 124, 122 and the release post. The notched plates 122, 124 and keeper plates 126, 128 were fastened to the release post 102 using two 0.5-inch diameter bolts that pass through the entire assembly. Each wire rope fitting 228, 230, 232 was fastened using a washer and double nut.

To resist the moment introduced into the release post 102 by the wire rope's eccentricities and angles, the release post 102 was braced approximately 30.2 inches above grade. The knee brace 104 used was fabricated from 2-inch wide×0.75-inch thick flat steel strap cut into interlocking sections 112, 114. Each section 112, 114 was 19.875-inch long overall and had a 0.75-inch diameter hole 610 located 1 inch from one end, along its centerline, or longitudinal axis $X_{brace\ portion}$. Opposite the hole, a catch, 602, configured as a single 0.5-inch deep tooth, was located along the section's centerline. Two sections 112, 114 were placed together, rotated 180 degrees about each centerline, and retained together using two #8-32 machine screws 158, lock washers, and nuts. Each machine screw 158 was located 1.75 inches on each side from the tooth face 626 (for example, as shown in FIG. 8). The overall hole-to-hole length for two sections connected was 31.25 inches. One 0.625 inch diameter×6.5-inch long bolt 118 passed through both knee braces 104 and the release post 102. The nut was not tightened. The knee brace 104 descended to an at grade anchor at 66 degrees from horizontal.

The knee braces 104 anchored to a HSS3×5×0.375 hollow structural section 110 that extended approximately 3 inches above grade. A single 0.625 inch diameter×6.5-inch long bolt 120 passed through both knee braces 104 and the HSS3×5×0.375 brace anchor 110. The nut was not tightened. The base of the HSS3×5×0.375 hollow structural section 110 attached to the W6×15 anchor base post 108 at about 12.75 inches below grade using two 0.5-inch diameter bolts 510. This HSS3×5×0.375 brace anchor 110 extended upward at a 45 degree angle. A S3×5.7 ground strut 502 (for example, as shown in FIG. 7) was used to form a truss-type connection between the diagonal HSS3×5×0.375 brace anchor 110 and the W6×15 main post 108. This ground strut 502 was bolted to the W6×15 main post 108 using two 0.5-inch diameter bolts 510, and was welded to the diagonal HSS3×5×0.375 hollow structural section 110. These components were encased in the reinforced concrete foundation 702 (for example, as shown in FIG. 9).

In a reverse direction impact (e.g., impact from a vehicle traveling in the second direction, for example, as indicated by arrow 218 in FIG. 3), notches in the front and rear notched plates allow the wire ropes to maintain tension only. If lateral loading (side-to-side) (e.g., perpendicular to the second direction) is induced, the wire rope end fittings 228, 230, 232 release by tearing through the keeper plates 126, 128. As a vehicle approaches the terminal 100, this lateral loading increases and causes the wire rope end fittings to rotate out of the notches 302. The notched plates 122, 124 may act as a fulcrum, such that ropes 204 attached to notches 302 on the side of the impact will rotate about the edge 306 of a notch in the notched plate 126 and ropes 202, 206 attached to notches on the side opposite of impact will rotate about the edge 306 of a notch 302 in the notched plate 124 until the keeper plates 126, 128 fail. The notches 302 have a sloped top and bottom 308, 310 to facilitate release if vertical load (up-and-down) is induced. As the vehicle approaches the terminal 100, it may push the wire ropes toward the ground or pull them up over the vehicle. This loading will cause the wire rope end fittings 228, 230, 232 to bear against the top or bottom slope of the notch 302 and rotate out of the notch 302.

Once the wire ropes 202, 204, 206 have released, whether from lateral or vertical load, the base of the release post 102 rests on an anchor 108 that does not develop significant resistance in the reverse direction. Construction bolts 138 may be used to support the release post 102 against minor impact, such as from weather or maintenance. The construction bolts 138 are designed to shear before sufficient resistance develops to cause deformation to the release post 102, such that the release post 102 may be reinstalled for subsequent use. The release post 102 will simply rotate about the bottom of the knee brace 104 bolt and lay over. If the release post 102 does not rotate about the bottom knee brace bolt 120, the knee brace sections 112, 114 will separate and allow the release post 102 to collapse, or lay over. For example, fasteners 158 holding the knee brace, or trigger, members 112, 114 together will fail in tension. Each knee brace section 112, 114 has a 45 degree notch or indent 604 where they interlock to facilitate this "slip joint" in the reverse direction.

In a head-on impact (e.g., when a vehicle 220 is traveling in the first direction, for example, as indicated by arrow 216 shown in FIG. 3B, and vehicle's first point of impact is at the knee brace, or trigger 104), the knee brace 104 is designed to be strong-in-tension, but weak in bending. If a lateral load (e.g., perpendicular to the first direction, as shown in FIG. 3C) is placed on the knee brace 104 at any location, the interlocking sections 112, 114 are designed to release after the tension strength of the #8 screws 158 is exceeded. Release of the knee brace 104 removes from the release post 102 its ability to resist moment, or any lateral force at any height. Next, the vehicle 220 impacts the release post 102. Since the release post 102 can no longer resist moment, it simply lays over and the vehicle 220 passes over it. Once the knee brace 104 has released, the tension in the wire ropes 202, 204, 206 is released.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

The invention claimed is:

1. A single anchor terminal comprising:

a release post having opposite first and second faces;

a cable having an end portion releasably coupled to the release post, the cable extending from the release post in a first direction;

a pair of notched plates disposed on the opposite first and second faces of the release post, each notched plate having laterally opening notches disposed along opposite side edges of each notched plate, wherein the end portion of the cable is received in the notches;

a brace supporting the release post in an upright position, the brace extending from the release post in a second direction opposite the first direction, the brace comprising a first portion attached to the release post and a second portion coupled to the first portion with a release component; and an anchor base comprising a main post supporting the release post and a brace anchor coupled to the main post, wherein the second portion of the brace is coupled to the brace anchor.

2. The single anchor terminal of claim 1 further comprising a pair of keeper plates disposed adjacent the notched plates, wherein the cable extends through openings in the keeper plates.

3. The single anchor terminal of claim 2 wherein the keeper plates are breakable in response to a load being applied by the cable.

4. The single anchor terminal of claim 1 further comprising a shear strap attached to the anchor base and engaging the release post, wherein the shear strap restrains movement of the release post relative to the anchor base in the first direction.

5. The single anchor terminal of claim 1, wherein the laterally opening notches comprise upwardly sloped edges and downwardly sloped edges.

6. The single anchor terminal of claim 1, wherein the release post is inclined in the second direction towards the brace relative to a vertical axis.

7. The single anchor terminal of claim 1 further comprising first, second and third cables each having end portions releasably coupled to the release post and extending from the release post in the first direction.

8. The single anchor terminal of claim 1 wherein the end portions of the first, second and third cables are coupled to the release post at first, second and third locations, and wherein the first portion of the brace is attached to the release post at a fourth location, wherein the first, second and third locations are positioned below the fourth location.

9. The single anchor terminal of claim 1 wherein the release post is releasably connected to the main post of the anchor base.

10. A single anchor terminal comprising:

a release post;

a cable having an end portion releasably coupled to the release post, the cable extending from the release post in a first direction;

a brace supporting the release post in an upright position, the brace extending from the release post in a second direction opposite the first direction, the brace comprising a first portion attached to the release post and a second portion coupled to the first portion with a release component, wherein the release component comprises a catch and an indent formed in adjoining ends of the first and second portions of the brace, wherein the catch of the first portion interlocks with and directly engages the indent in the second portion and the catch of the second portion interlocks with and directly engages the indent in the first portion; and an anchor base comprising a main post supporting the release post and a brace anchor coupled to the main post, wherein the second portion of the brace is coupled to the brace anchor.

11. The single anchor terminal of claim 10, wherein:

the release component further comprises a fastener coupling the adjoining ends of the first and second portions of the brace.

12. The single anchor terminal of claim 10, wherein:

the catch of each of the first and second portions of the brace comprises an inclined edge and a perpendicular edge relative to longitudinal axes of the first and second portions;

the indent of each of the first and second portions comprises an inclined edge and a perpendicular edge relative to the longitudinal axes of the first and second portions;

when a tensile force applied along the longitudinal axes of the first and second portions, the perpendicular edge of the catch of the first portion is configured to abut the perpendicular edge of the indent of the second to provide resistance against the tensile force; and when a compressive force is applied along the longitudinal axes of the first and second portions, the inclined edge of the catch of the first portion is adapted to slip against the inclined edge of the indent of the second portion to decouple the adjoining ends of the first and second portions of the brace.

13. A method for installing a single anchor terminal, the method comprising:

attaching a brace anchor to a main post of the single anchor terminal, the brace anchor forming a truss extending from the main post;

installing at least a portion of the brace anchor and the main post above grade;

supporting a release post having opposite first and second faces on the main post;

supporting the release post in an upright position by inserting a brace between the release post and the brace anchor, wherein inserting the brace comprises coupling a first portion of the brace to the release post and coupling a second portion of the brace to the above grade portion of the brace anchor;

disposing a pair of keeper plates at the opposite first and second faces of the release post, each keeper plate having openings to receive an end portion of a cable;

disposing a pair of notched plates adjacent the keeper plates to align laterally opening notches disposed along opposite sides edges of the notched plates with the openings of the keeper plates; and extending the end portion of the cable through the openings and adjoining the first and second portions of the brace being with a release component.

14. The method of claim 13 further comprising:

applying tension along the cable in a first direction, the brace anchor extending from the main post in a second direction opposite the first direction; and thereby applying tension along longitudinal axes of the first and second portions of the brace.

15. A single anchor terminal comprising:

a release post;

a cable having an end portion releasably coupled to the release post, the cable extending from the release post in a first direction;

a brace supporting the release post in an upright position, the brace extending from the release post in a second direction opposite the first direction, the brace comprising a first portion attached to the release post and a second portion coupled to the first portion with a release component; and an anchor base comprising a main post supporting the release post and a brace anchor coupled to the main post, wherein the second portion of the brace is coupled to the brace anchor; wherein the brace anchor comprises a first end connected to the main post below grade, and wherein the brace anchor extends upwardly from the first end and has a second end positioned above grade, wherein the second portion of the brace is coupled to the second end of the brace anchor, and further comprising a strut coupled to the main post and to the brace anchor between the first and second ends of the brace anchor.

16. The single anchor terminal of claim 15 wherein the brace anchor forms a 45 degree angle with the main post.

17. The single anchor terminal of claim 15 wherein the strut is positioned below grade.

* * * * *